United States Patent [19]

Helm

[11] 4,318,661

[45] Mar. 9, 1982

[54] DRUM HANDLING DEVICE FOR FORKLIFT

[75] Inventor: J. Thomas Helm, Franklin, Tenn.

[73] Assignee: Dozier Equipment International Company, Nashville, Tenn.

[21] Appl. No.: 133,020

[22] Filed: Mar. 24, 1980

[51] Int. Cl.[3] ..... B66F 9/18

[52] U.S. Cl. ..... 414/607; 414/620; 294/87 R; 294/90; 294/103 R

[58] Field of Search ..... 414/607, 608, 619, 620, 414/621; 294/87 R, 90, 103 R

[56] References Cited

U.S. PATENT DOCUMENTS 2,582,663 1/1952 Weiss ..... 414/607
2,842,275 7/1958 Kughler ..... 414/621
3,172,693 3/1965 Hansen ..... 294/90

FOREIGN PATENT DOCUMENTS 307056 11/1969 U.S.S.R. ..... 414/608

*Primary Examiner*—Robert W. Saifer
*Attorney, Agent, or Firm*—Harrington A. Lackey

[57] ABSTRACT

A drum handling attachment for a forklift truck including a frame for attachment to the forks of the forklift truck, and supporting a transverse rotary shaft upon which are mounted for rotary movement therewith, at least a pair of gripping arms, at least one of the gripping arms being transversely adjustable on the shaft for handling one or more drums of different sizes.

8 Claims, 12 Drawing Figures

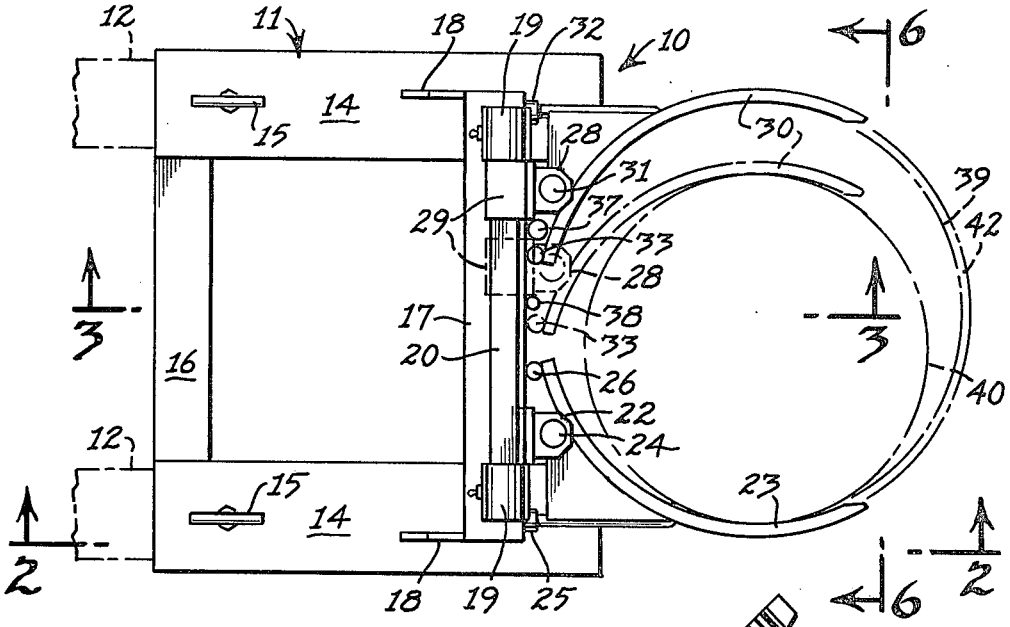
Fig. 1
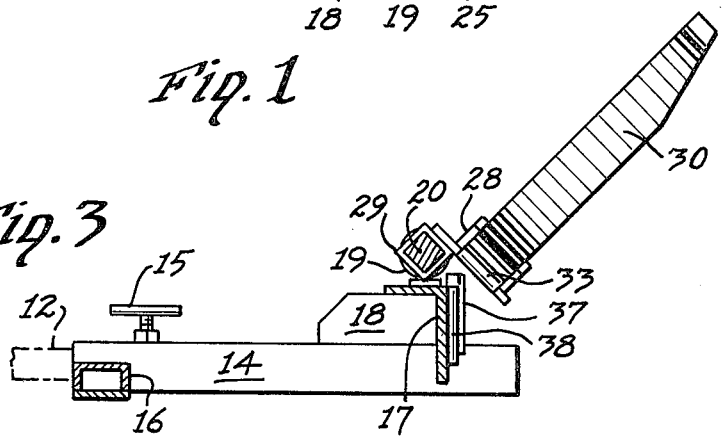
Fig. 3
Fig. 2
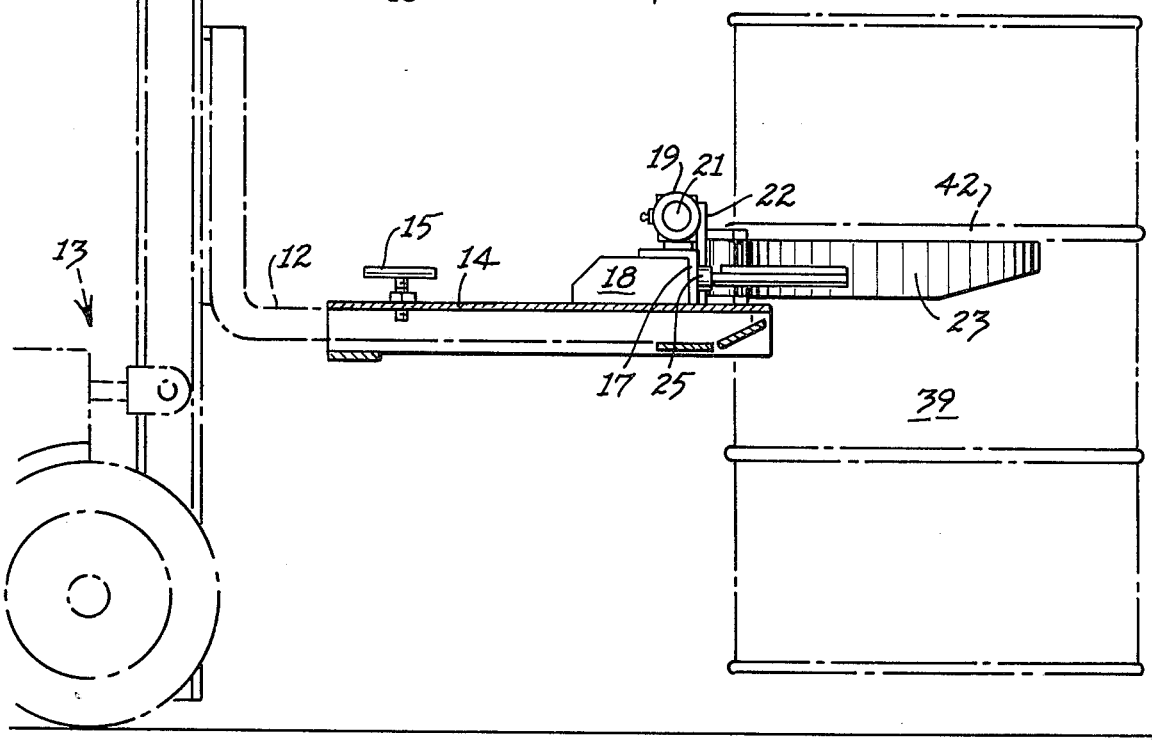

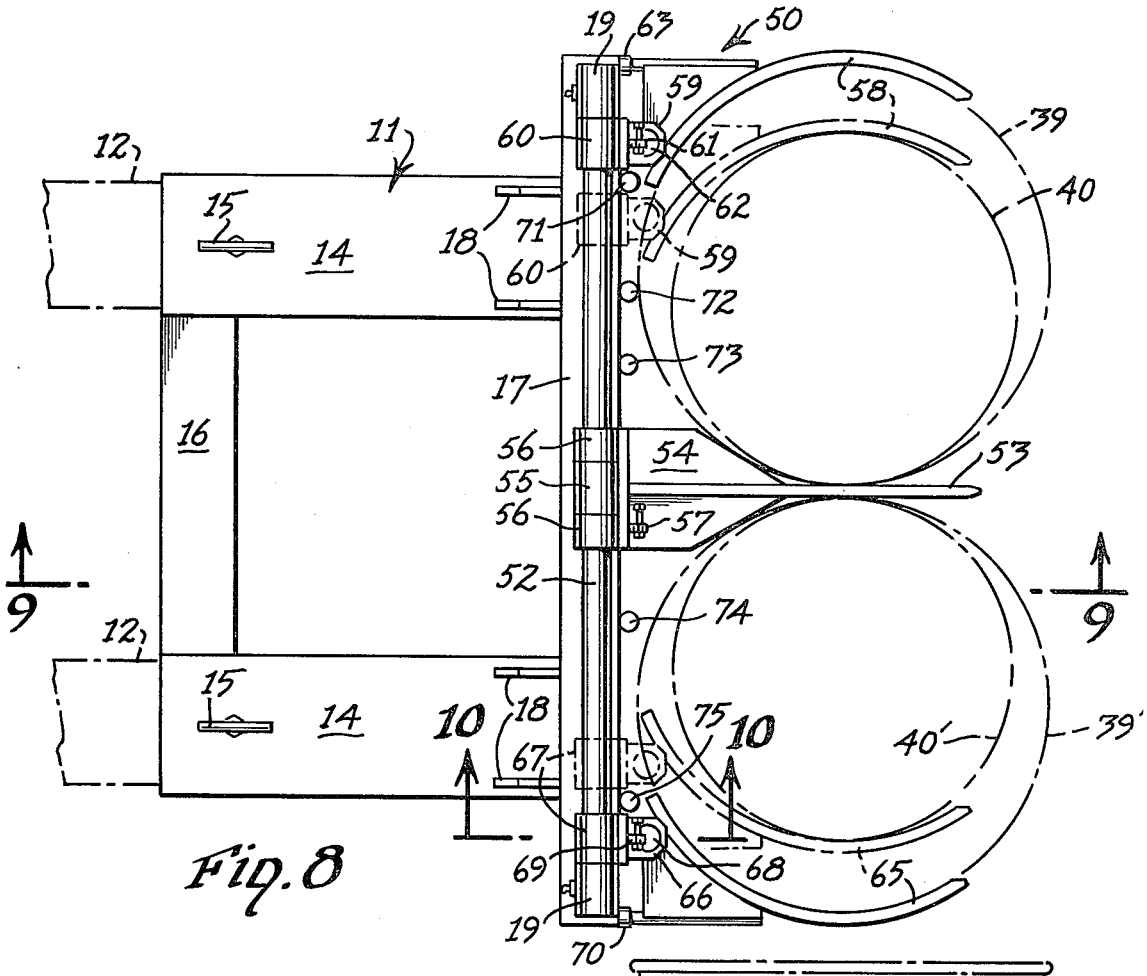
Fig. 8
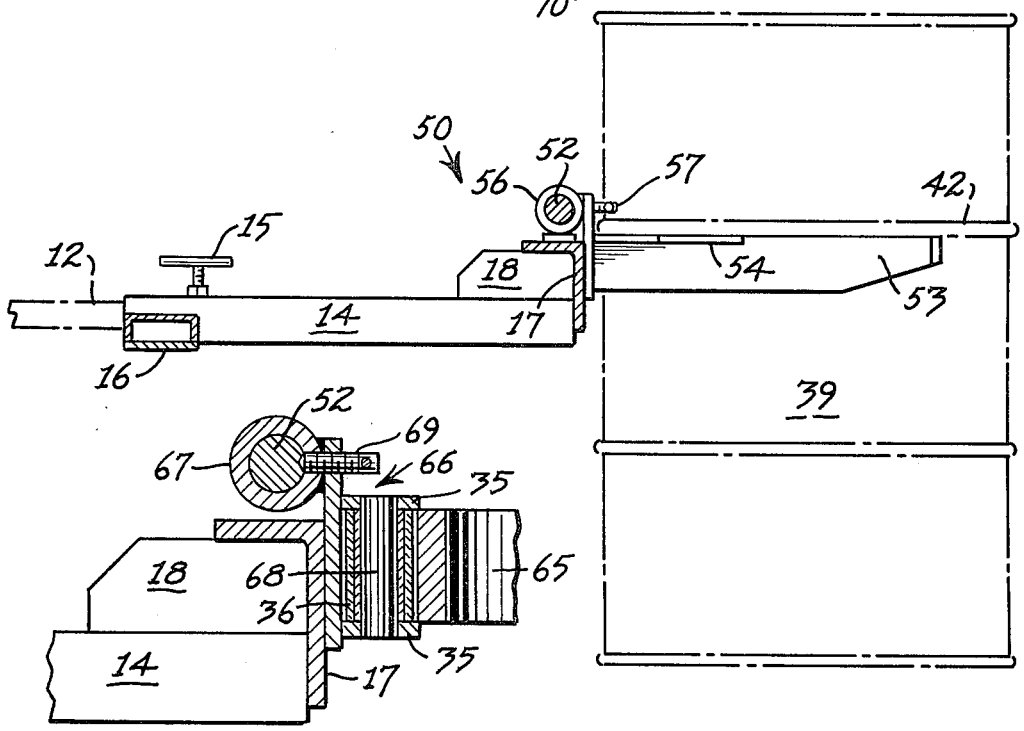
Fig. 10
Fig. 9

DRUM HANDLING DEVICE FOR FORKLIFT

BACKGROUND OF THE INVENTION

This invention relates to a drum handling attachment for a forklift truck, and more particularly to such a drum handling attachment including adjustable gripping arms.

Drum handling attachments for forklift trucks having grip arms for handling one or more drums are well known in the art.

The following U.S. Pat. Nos. disclose drum hanlding attachments in which the grip arms are laterally adjustable:

2,582,663; Weiss, Jan. 15, 1952;
2,795,347; Schenkelberger, June 11, 1957;
3,172,693; Hansen, Mar. 9, 1965;
3,319,815; Vik, May 16, 1967;
3,410,431; Vik, Nov. 12, 1968;
3,438,669; Vik, Apr. 15, 1969;
3,971,485; Hoppey, July 27, 1976.

Furthermore, drum handling attachments for forklift trucks are known which include a transverse fixed shaft about which the gripping arms are independently vertically pivoted in order to adjust the arms laterally for accommodating drums of different sizes. However, this independent pivotal movement of the gripping arms permits the arms to grip a drum at varying vertical angles, that is the gripping arms are not maintained in the same horizontal plane while they are gripping the drum, which is an unsafe procedure for handling drums.

The following U.S. patents disclose drum handling devices in which the gripping arms are hinged for movement about verical axes and also for simultaneous movement about horizontal axes, but in which the gripping arms are not laterally adjustable:

U.S. Pat. No. 2,497,118; Ferrario et al, Feb. 14, 1950;
U.S. Pat. No. 2,842,275; Kughler, July 8, 1958;
U.S. Pat. No. 2,948,428; Kughler, Aug. 9, 1960.

The above cited Hansen patent 3,172,693 also discloses the utilization of stops for locating laterally the laterally adjustable gripping arms.

SUMMARY OF THE INVENTION

It is therefore an object of this invention to provide a drum handling attachment for mounting upon the forks of a forklift truck incorporating a rotary transverse shaft upon which the gripping arms are mounted for lateral adjustment, but are limited to rotary vertical movement together with the rotary movement of the rotary shaft. In this manner, the gripping arms are always maintained in the same transverse plane and particularly when they are used in approaching, gripping and handling a vertically disposed drum.

One gripping arm of the drum handling attachment is maintained in a fixed position upon the rotary shaft so that it moves rotationally with the shaft, but does not move axially. The other gripping arm or arms are secured to a collar or collars, mounted on the rotary shaft, for free axial, but non-rotary movement relative to the shaft. However, the collar does rotate with the rotary shaft.

Transversely spaced stop pins are provided to locate the adjustable gripping arms in relatively fixed, horizontally spaced positions for gripping a drum or drums of corresponding sizes. The spacing between the gripping arms is changed by raising the gripping arms to that they rotate with the shaft to a position above the stop pins whereby the laterally adjustable gripping arm or arms are then free to be axially shifted to different gripping positions.

DESCRIPTION OF THE PREFERRED EMBODIMENTS

FIG. 1 is a top plan view of a single-drum handling attachment mounted upon the forks, shown in phanton, of a forklift truck, and illustrating the gripping arms in two different positions for handling drums of two different sizes;

FIG. 2 is a section taken along the line 2—2 of FIG. 1, showing a portion of a forklift truck in phantom, and showing the gripping arms in their lower operative position lifting a drum, shown in phantom;

FIG. 3 is a section taken along the line 3—3 of FIG. 1 showing the movable gripping arm in its elevated position for adjustable movement;

FIG. 8 is a top plan view of a modified double-drum handling attachment mounted on the forks, shown in phantom, of a forklift truck, and illustrating the gripping arms in two different positions for handling a pair of drums of different sizes;

FIG. 9 is a section taken along the line 9—9 of FIG. 10;

FIG. 10 is an enlarged, fragmentary section taken along the line 10—10 of FIG. 8;

DESCRIPTION OF THE PREFERRED EMBODIMENTS

Figure 4:
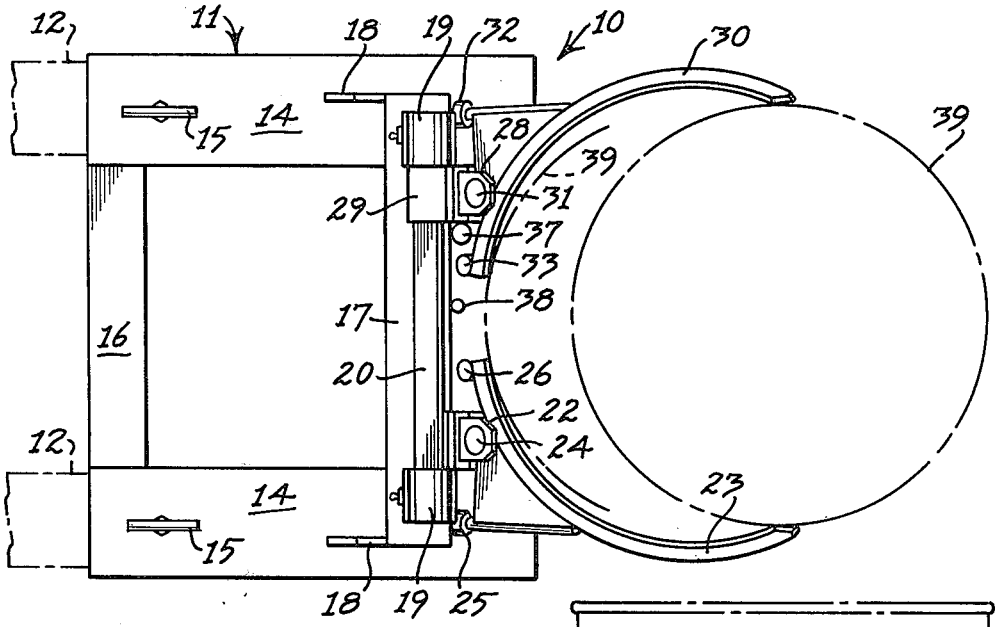
FIG. 4 is a top plan view, similar to FIG. 1, illustrating the gripping arms pivoted to a spread position preparatory to engaging a drum.
Figure 5:
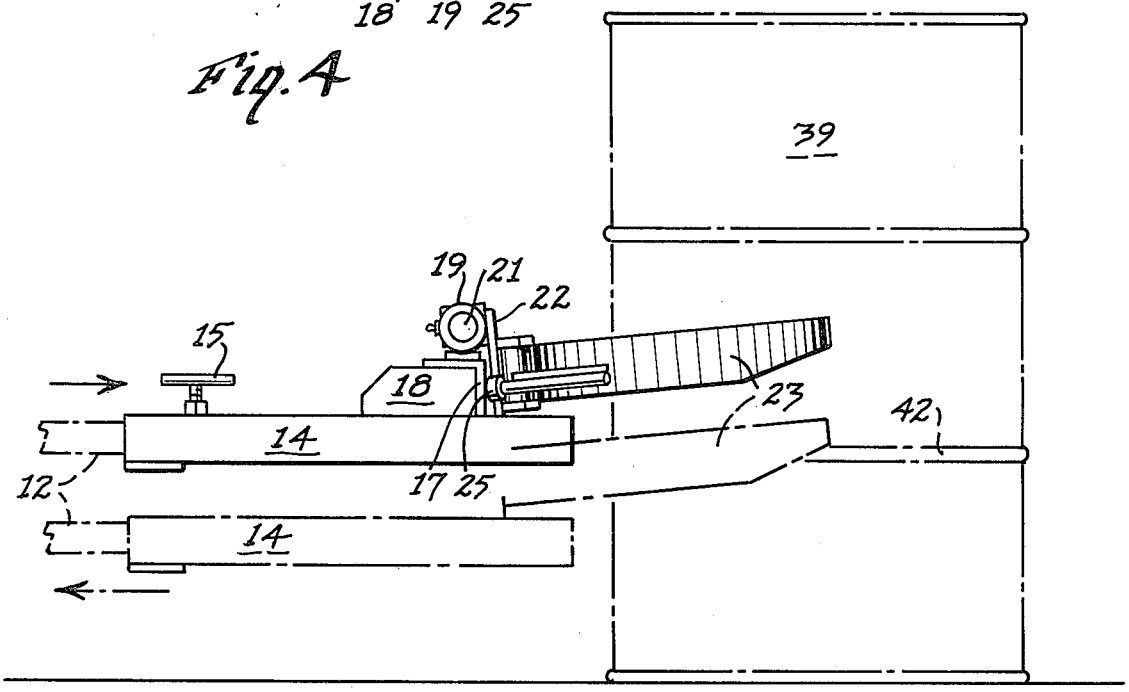
FIG. 5 is a side elevation of the device disclosed in FIG. 4, illustrating the gripping arms approaching the drum for engagement in solid lines, and withdrawing from the drum for disengagement, in phantom.
Figure 6:
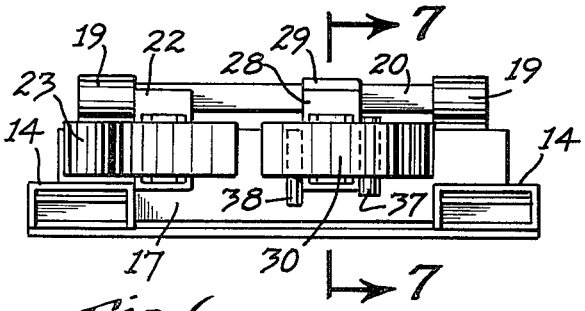
FIG. 6 is a view taken along the line 6—6 of FIG. 1.

Referring now to the drawings in more detail, FIGS. 1–7 disclose a single-drum handling device 10, including a frame 11 adapted to be supported upon the forks 12 of a forklift truck 13 (FIG. 2).

The frame 11 includes a pair of elongated fork sleeves 14 adapted to slip over the respective forks 12. Each sleeve 14 is provided with a turn screw member or T-bolt 15 for holding the sleves 14 upon their respective forks 12. The sleeves 14 are held together by a rear transverse beam 16 and a front transverse mounting bar 17 of angle iron supported at its ends by the end plates 18.

Mounted on top of the mounting bar 17 adjacent its opposite ends are a pair of journal bearings 19 for rotatably supporting the transversely extending, rotary shaft 20 of square cross-section. The end pieces 21 of the shaft 20 are circular for free rotatable movement within the cylindrical journal bearings 19.

Fixed to one end portion of the rotary shaft 20 is a first bracket 22 for pivotally supporting a first arcuate drum gripping arm 23. When the gripping arm 23 is in a tilted or elevated position, it is free to pivot about the pivotal axis of the pivot post 24 in the bracket 22. However, when the gripping arm 23 is in its horizontal position, as disclosed in FIGS. 1 and 2, its pivotal movement about the pivot post 24 is restrained by the stop member 25 and the stop rod 26. Since the bracket 22 is fixed to the rotary shaft 20, the bracket 22 and the gripping arm 23 will rotate in a vertical plane with the rotary shaft 20, but are restrained against axial movement relative to the rotary shaft 20.

A second mounting bracket 28 of substantially the same construction as the mounting bracket 22 is fixed to a collar 29 having a coaxial hole therethrough of square cross-section for slidably receiving the square rotary shaft 20. A second arcuate gripping arm 30 is pivotally supported upon the mounting bracket 28 for limited pivotal movement about the pivot post 31, in the same manner as the gripping arm 23 pivots about the pivot post 24.

However, the gripping arm 30 is adapted to be trasversely or laterally adjustable toward and away from the fixed arcuate gripping arm 23 by virtue of its mounting upon the axially slidable collar 29. The adjustable gripping arm 30 is also provided with a stop member 32 and a stop rod 33 to restrain the horizontal pivotal movement of the gripping arm 30 when it is in its lowermost, horizontal, operative position.

Figure 7:
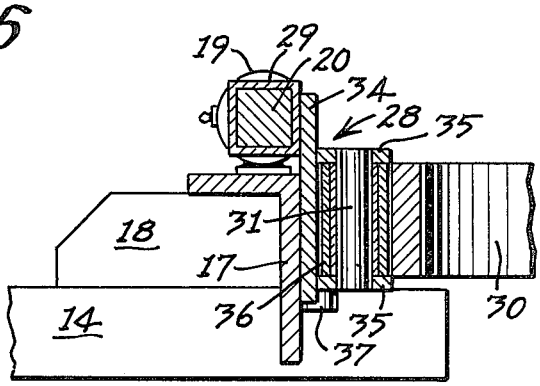
FIG. 7 is an enlarged fragmentary section taken along the line 7—7 of FIG. 6.

As illustrated in FIG. 7, the mounting bracket 28 may include a mounting plate 34, which is fixed to the square collar 29. The bracket mounting plate 34 has a pair of forward projecting flanges 35 spaced vertically for receiving the pivot post 31. A rotary sleeve 36 is journaled around the pivot post 31 and fixed to the gripping arm 30. The first pivotal bracket 22 may have the identical construction as the bracket 28.

In order to prevent transverse movement of the second gripping arm 30 in the two operative positions disclosed in FIG. 1, a pair of transversely spaced stop pins 37 and 38 are fixed to the mounting bar 18. In its solid-line, outboard position disclosed in FIG. 1, the bracket 28 is confined between the stop pin 37 and the journal bearing 19. In its phantom, inboard position disclosed in FIG. 1, the bracket 28 is confined between the stop pins 37 and 38. Thus the gripping arm 30 is limited in its phantom, inboard position for engaging a drum 40 of smaller size, such as a 30-gallon drum, while in its solid-line, outboard position, the gripping arm 30 is adapted to engage a larger drum 39, e.g., a 55-gallon drum.

In the operation of the device 10, the fork sleeves 14 are slipped over the forks 12 of a forklift truck 13, and when in position, the turn screws 15 are manually turned until the sleeves 14 are held in a tight positions upon the forks 12. The gripping arm 30 is then adjusted to its desired lateral position, depending upon whether a small 30-gallon drum 40 or a larger 55-gallon drum 39 is to be handled.

If the gripping arm 30 is in its phantom position for handling a 30-gallon drum 40, and it is desired to handle a 55-gallong drum 39, the arms 23 and 30 are manually elevated together to a position, such as that disclosed in FIG. 3, simultaneously rotating the rotary square shaft 20 in a counterclockwise direction, as viewed in FIG. 3, in its journal bearings 19. In the elevated position of FIG. 3, the bracket 28 has cleared, or in other words is above, the stop pin 37, so that the collar 29 may be moved axially outboard to its solid-line position disclosed in FIG. 1, between the stop pin 37 and the journal bearing 19. In the outboard position, the arms 30 and 23 are lowered by gravity to assume their lowermost horizontal position.

The operator then moves the forklift truck 13 toward the upright 55-gallon drum 39 until the tips of the arms 30 and 23 engage the outer surface of the drum 39. Continued movement of the forklift truck 13 toward the drum 39 causes the arms 30 and 23 to tilt upwardly, and since they are rotationally locked to the square rotary shaft 20, the arms 30 and 23 are elevated simultaneously together and to the same extent. After the arms 23 and 30 have been tilted upwardly and simultaneously spread apart by their pivoting about the pivot posts 24 and 31, continued forward movement of the device 10 permits the arms 30 and 23 to move past the greatest diameter of the drum 39, so that the arms 30 and 23 begin to fall to their lowermost horizontal position, surrounding the drum 39 below one of the circumferential ribs 42. The forks 12 may then be raised until the arms 23 and 30 engage the drum rib 42, and continued upward movement of the forks 12 causes the gripping arms 23 and 30 to lift the drum 39 through their engagement with the rib 42.

After the forklift truck has carried the drum 39 to its desired destination, the release procedure is effected. The forks 12 are lowered until the drum 39 rests upon the floor, causing the arms 23 and 30 to disengage the rib 42 above the arms. Lowering of the forks is continued, with the forklift truck 13 at rest, until the arms 23 and 30 contact the next lower rib 42, as illustrated in the phantom position of FIG. 5. Then, the forlift truck 13 is moved rearward simultaneously with a continued lowering of the forks 12. This action forces the arms 23 and 30 to spread apart and to simultaneously tilt upward, pivoting about the posts 24 and 31 and causing the shaft 20 to rotate in its journal bearings 19. After the gripping arms 23 and 30 have cleared the drum 39, the arms fall to their normal lowermost position.

Should it be desired to lift a smaller 30-gallon drum 40, the arms 23 and 30 are again elevated to their position disclosed in FIG. 3, so that the collar 29 may be shifted inboard over the stop pin 37 and lowered so that the bracket 29 is locked between the pins 38 and 37. The gripping and lifting procedure is then repeated for the smaller drum 40.

A modified device 50 is disclosed in FIGS. 8–12, in which either a single drum or a pair of drums, of the same, or different sizes, may be handled.

The device 50 incorporates the same frame 11 as incorporated in the device 10. The frame 11 includes the same elements 14–19 as incorporated in the frame of the device 10. Moreover, the frame 11 is adpated to be fitted upon a pair of forks 12 for the forklift truck 13 in the same manner as that disclosed in FIGS. 1–7.

However, instead of a square shaft 20, a round rotary shaft 52 is journaled at its end portions in the journal bearings 19.

In the device 50, a substantially straight, center, drum-gripping arm 53 is fixed by a bracket 54 to a circular journal sleeve 55 adapted to rotate between a pair of collars 56 fixed to the rotary shaft 52. The bracket 54 may be detachably locked to one of the fixed collars 56 by a threaded locking pin 57. Thus, when the locking pin 57 engages a corresponding aperture in the collar 56, the center arm 53 and bracket 54 are fixed to the shaft 52, so that the center arm 53 will rotate with the shaft 52, when the shaft 52 is rotated.

Supported on one side and opposing the fixed center arm 53 is an outboard or second gripping arm 58 which is pivotally mounted upon a bracket 59, which in turn is fixed to a cylindrical collar 60 freely axially slidable and rotatable upon the shaft 52. Normally, the collar 60 is fixedly secured to the shaft 52 by means of another threaded locking pin 61. The arm 58 is adapted to pivot about the pivot post 62 when in an elevated position. The gripping arm 58 is also provided with a stop member 63.

The gripping arm 58, bracket 59 and collar 60 are substantially identical in construction to the arm 30, bracket 28, and collar 29 disclosed in FIGS. 1–7, with the exception of the shape of the shaft holes through the respective collars 29 and 60. The shaft hole through the collar 29 is square, whereas the shaft hole 60 is circular to slidably receive the circular rotary shaft 52.

A third gripping arm 65 is mounted on the opposite side of the center arm 53 and is pivotally supported upon a mounting bracket 66. The bracket 66 is fixed to the cylindrical collar 67 which is axially slidably mounted upon the round rotary shaft 52. The gripping arm 65 is adapted to pivot about the axis of the pivot post 68 in the bracket 66.

The construction of the gripping arm 65, bracket 66 and collar 67 are identical to the corresponding gripping arm 58, bracket 59 and collar 60, with the exception that the respective parts are the mirror images of each other.

The collar 67 is normally locked in fixed position upon the shaft 52 by the threaded locking pin 69. The gripping arm 65 is also provided witha stop member 70 identical to the stop member 63.

Fixed to the mounting bar 17 are a plurality of transversely spaced stop pins 71, 72, 73, 74 and 75, the functions of which are essentially the same as the stop pins 37 and 38.

The operation of the drum handling device 50 is essentially the same as that of the device 10.

When the center arm 53 and the outboard arms 58 and 65 are disposed in their lowermost solid-line positions as disclosed in FIGS. 8 and 9, the device 50 is adapted to grip and handle a pair of large 55-gallon drums 39 and 39'. The outboard gripping arms 58 and 65 are held in their outermost solid-line positions by the engagement of the respective collars 60 and 67 with the journal bearings 19. The arms 58 and 65 may be laterally or transversely adjusted to different positions by raising all three of the arms 58, 53, and 65 simultaneously, thereby rotating the pivotal shaft 52 in its journal bearings 19 until the arms 58 and 65 have cleared the stop pins 71–75. If it is desired to handle a pair of drums 40 and 40' of small 30-gallon size, then when the arms 58 and 65 are in their elevated positios they are moved inboard to the phantom positions disclosed in FIG. 8 just on the inside of the stop pins 71 and 75, and lowered or dropped to their lowermost positions.

Of course, it is also possible for the device 50 to grip and handle one large drum 39 and a small drum 40' by permitting the gripping arm 58 to remain in its outboard solid-line position, and to shift inboard only the gripping arm 65. Conversely, it is possible for the device 50 to carry a small drum 40 on one side and a large drum 39' on the opposite side of the center arm 53, by shifting the arm 58 to its phantom, inboard position, and the arm 65 to its solid-line outboard position of FIG. 8.

Figure 11:
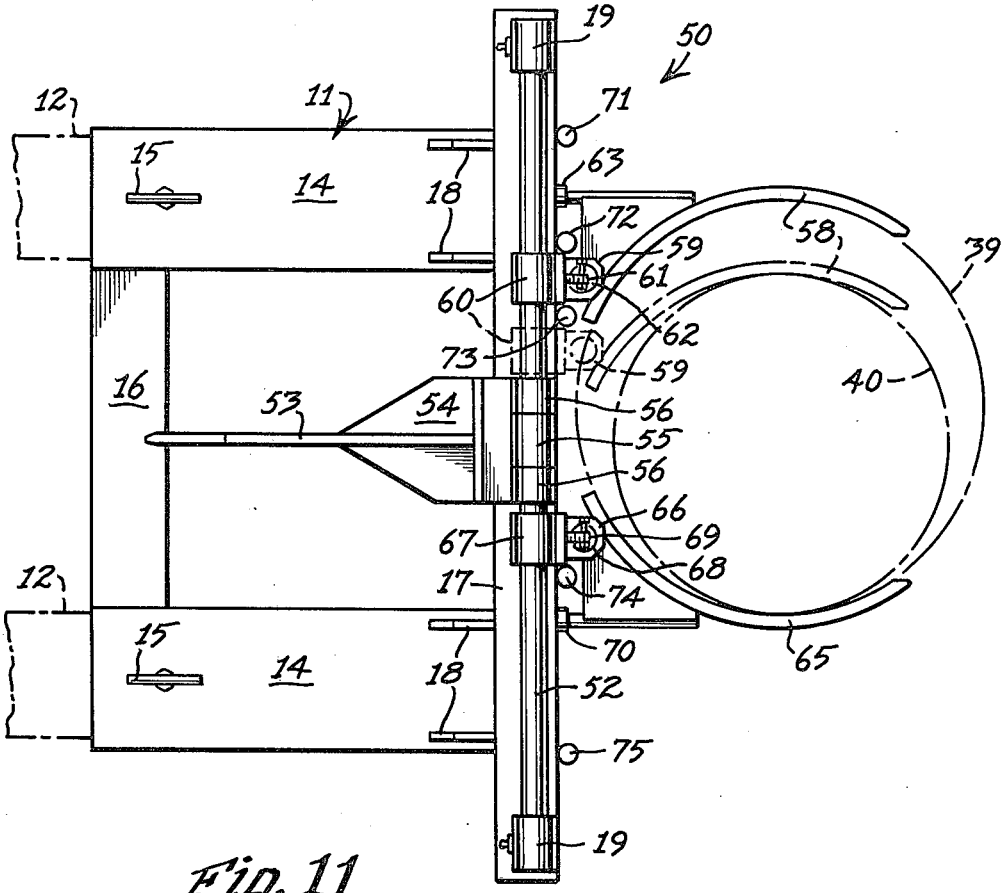
FIG. 11 is a view similar to FIG. 8 in which the attachment has been adjusted for handling a single drum, and in which the gripping arms are shown in two different positions for handling a drum of two different sizes.
Figure 12:
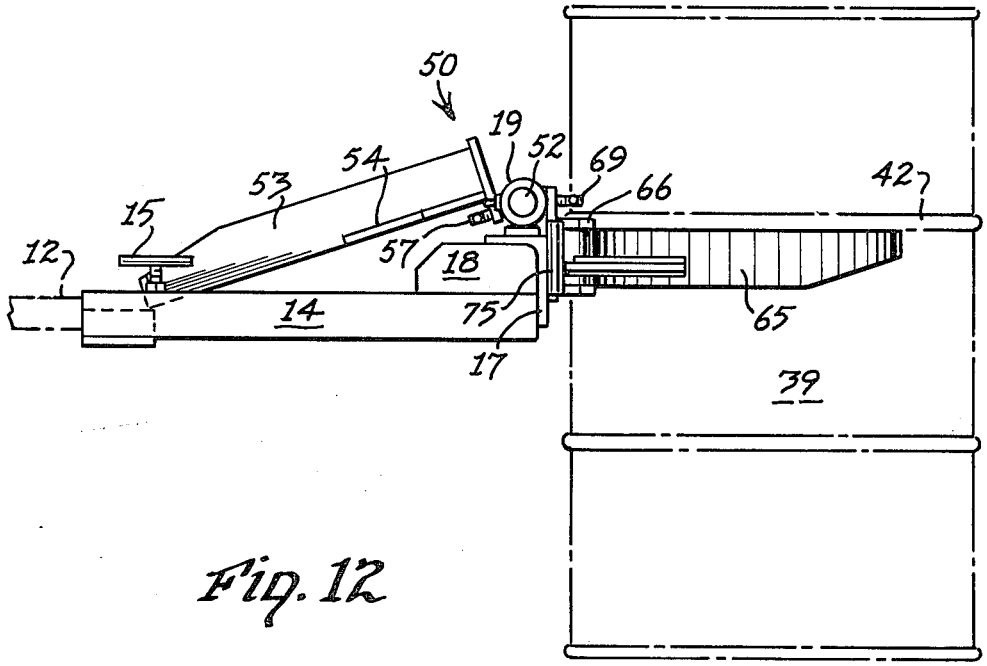
FIG. 12 is a side elevation of the device discloses in FIG. 11.

By unlatching the bracket 54 from the collars 56, the center arm 53 may be rotated through approximately 180° to its rearmost inoperative position disclosed in FIGS. 11 and 12, thereby permitting the remaining gripping arms 58 and 65 to function to carry a single drum either a large single drum 39 or a smaller drum 40. In this instance, the arm 65 will be moved to its inboard position where the bracket 66 is just inside the stop pin 74, so that the arm 65 then functions in the same manner as the fixed arm 23 in the device 10 of FIGS. 1–7. The arm 58 may be shifted inboard until its bracket 59 is just inside the stop pin 72 whereby a large 55-gallon drum 39 may be handled.

However, if it is desired for the device 50 to carry a single small-size, or 30-gallon, drum 40, then the arm 58 is shifted until its bracket 59 is just inside the stop pin 73, as illustrated by the phantom position of FIG. 11.

In shifting the gripping arms 58 and 65 along the circular rotary shaft 52, the only difference in procedure from that of shifting the arms 30 and 23 in the device 10 is that the locking pins 61 and 69 of the device 50 must be released to permit axial movement of the respective collars 60 and 67 along the rotary shaft 52. On the other hand, the collar 29 of the device 10 is automatically movable axially because its shaft hole has a non-circular, or square, cross-section to mate with the non-circular, or square, cross-section of rotary shaft 20, and therefore does not require any locking or unlocking.

However, where locking pins 61 and 69 are used to lock their respective collars 60 and 67 in various axial positions on the rotary shaft 52, stop pins, such as 71, 72, 73, 74 and 75 may be eliminated, except as added security against axial movement.

In either device 10 or 50, the operative gripping arms, whether they are 23 and 30 or 53, 58 and 65, or 58 and 65, are always maintained in the same plane as they move rotationally between their operative and inoperative positions. Thus, no gripping arm ever moves in a vertical plane independently of the other gripping arm or arms, particularly when engaging and gripping the particular drum 39 or 40 handled by the respective device 10 or 50.

What is claimed is:

1. A drum handling device for attachment to a forklift truck having forks, comprising:

(a) a frame having longitudinal and transverse dimensions, (b) means for detachably mounting said frame on the forks of a forklift truck, (c) a rotary shaft having a rotary axis, (d) journal means on said frame supporting said rotary shaft for rotary movement about its rotary axis transversely of said frame, (e) at least two gripping arms, including first and second opposed gripping arms adapted to grip opposite sides of a drum, (f) first bracket means supporting said first gripping arm and operatively mounted on said rotary shaft for simultaneous rotary movement with said rotary shaft, (g) second bracket means supporting said second gripping arm and operatively mounted on said rotary shaft for simultaneous rotary movement with said rotary shaft and for axial movement relative to said rotary shaft, and (h) means for limiting the axial movement of said second bracket means on said rotary shaft while said second gripping arm is in its lowermost operative position.

2. The invention according to claim 1 in which said limiting means comprises transversely spaced stop pins on said frame located at positions to limit the transverse movement of said second arm relative to said first arm for engagement of drums of different sizes.

3. The invention according to claim 2 in which said stop pins are of limited height to permit free transverse axial movement of said second bracket means on said rotary shaft when said gripping arms have been rotated to a predetermined elevated position.

4. The invention according to claim 1 in which said rotary shaft has a non-circular cross-section and said second bracket means comprises a collar of the same cross-section as said rotary shaft and receiving said rotary shaft for free axial slidable movement of said collar along said shaft.

5. The invention according to claim 1 in which said rotary shaft has a circular cross-section and said second bracket means comprises a collar of circular cross-section receiving said rotary shaft, said limiting means comprising locking means releasably locking said collar to said rotary shaft for simultaneous rotary movement of said collar with said rotary shaft.

6. The invention according to claim 1 in which at least one of said gripping arms is pivotally mounted upon its corresponding bracket means for limited pivotal movement about an axis normal to said rotary axis.

7. The invention according to claim 1 further comprising a third gripping arm and a third bracket means supporting said third gripping arm and operatively mounted on said rotary shaft for simultaneous rotary movement with said rotary shaft and for axial movement relative to said rotary shaft, said third bracket means being located transversely on the opposite side of said first bracket means from said second bracket means so that said first gripping arm can grip the opposed interior surfaces of a pair of drums, while the second and third gripping arms grip the opposite sides of said respective pair of drums, for handling a pair of drums simultaneously.

8. The invention according to claim 7 in which said first bracket means is rotatably mounted upon said rotary shaft and further comprising locking means for locking said first bracket means upon said rotary shaft for simultaneous rotary movement therewith, said locking means being adapted to be unlocked to permit said first gripping arm to be rotated to an inoperative position so that said second and third gripping arms may grip and handle a single drum.

* * * * *